US006994600B2

(12) United States Patent
Coulon

(10) Patent No.: US 6,994,600 B2
(45) Date of Patent: Feb. 7, 2006

(54) CONTACTING PART FOR ELECTRICAL CONNECTOR

(76) Inventor: Guy Coulon, 3, rue de l'Etang, Rocquencourt (FR) 78150

( * ) Notice: Subject to any disclaimer, the term of this patent is extended or adjusted under 35 U.S.C. 154(b) by 0 days.

(21) Appl. No.: 10/822,396

(22) Filed: Apr. 12, 2004

(65) Prior Publication Data

US 2004/0242085 A1 Dec. 2, 2004

(30) Foreign Application Priority Data

Apr. 15, 2003 (FR) ..... 03 04689

(51) Int. Cl.
*H01R 13/187* (2006.01)

(52) U.S. Cl. ..... 439/843

(58) Field of Classification Search ..... 439/842–844, 439/846–848, 851–853, 856–858
See application file for complete search history.

(56) References Cited

U.S. PATENT DOCUMENTS

| | | | | | |
|---|---|---|---|---|---|
| 5,322,459 | A * | 6/1994 | Spinnato | 439/843 |
| 5,419,723 | A * | 5/1995 | Villiers et al. | 439/843 |
| 5,476,399 | A | 12/1995 | Porter | 439/843 |
| 5,516,310 | A * | 5/1996 | Sawada | 439/843 |
| 5,529,518 | A * | 6/1996 | Wood | 439/843 |
| 5,685,746 | A * | 11/1997 | Maejima | 439/845 |
| 5,735,716 | A * | 4/1998 | Bilezikjian | 439/843 |
| 5,775,960 | A * | 7/1998 | Saito et al. | 439/843 |
| 5,897,404 | A * | 4/1999 | Goodman et al. | 439/843 |
| 5,975,964 | A * | 11/1999 | Seko et al. | 439/857 |
| 6,102,752 | A * | 8/2000 | Bommel et al. | 439/845 |
| 6,250,974 | B1 * | 6/2001 | Kerek | 439/843 |
| 6,261,134 | B1 * | 7/2001 | Muzslay | 439/852 |
| 6,264,508 | B1 * | 7/2001 | Lehmann | 439/843 |
| 6,394,858 | B1 * | 5/2002 | Geltsch et al. | 439/852 |
| 6,439,935 | B2 * | 8/2002 | Saka et al. | 439/852 |
| 6,475,039 | B1 * | 11/2002 | Despouys | 439/843 |
| 6,811,453 | B2 * | 11/2004 | Williams | 439/843 |
| 6,896,545 | B2 * | 5/2005 | Suess et al. | 439/521 |
| 2001/0019925 | A1 * | 9/2001 | Heimueller | 439/851 |
| 2001/0051471 | A1 * | 12/2001 | Saka et al. | 439/843 |
| 2002/0055305 | A1 * | 5/2002 | Williams | 439/851 |
| 2004/0033733 | A1 * | 2/2004 | Feldman | 439/843 |
| 2005/0054247 | A1 * | 3/2005 | Lutsch et al. | 439/843 |

FOREIGN PATENT DOCUMENTS

| | | |
|---|---|---|
| EP | 1 107 378 A1 | 6/2001 |
| EP | 0 476 848 A1 | 3/2002 |
| EP | 1 107 378 B1 | 6/2003 |

* cited by examiner

*Primary Examiner*—Ross Gushi
(74) *Attorney, Agent, or Firm*—Perman & Green, LLP

(57) ABSTRACT

The present invention relates to a contacting part for an electrical connector, consisting of a male contacting portion and of a female contacting portion, the female contacting portion consisting of a body having a longitudinal axis of symmetry and an end of which is provided with a housing axially positioned in said body and compatible with the shape and the dimensions of said male contact and characterized in that an external surface of the body distant from this end is in electrical contact with an annular crown extending towards the aperture of the housing through a contact clip achieving the electrical contact with the male contacting portion, the contact clip being provided with at least two resilient tabs, joined to the annular crown and arranged so as to be interposed on the path for inserting the male contacting element into the housing.

22 Claims, 6 Drawing Sheets

CONTACTING PART FOR ELECTRICAL CONNECTOR

Figure 1:
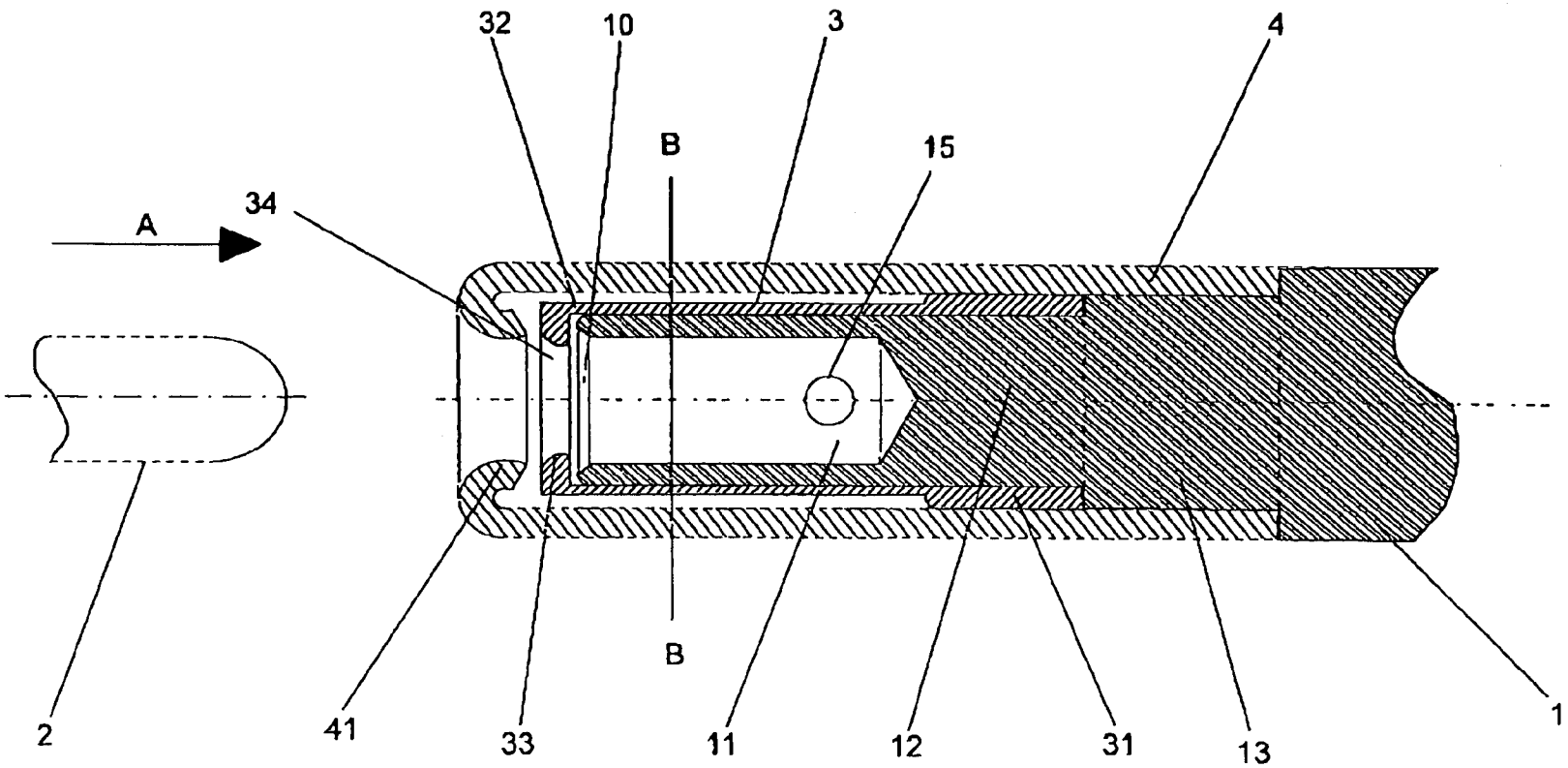

The present invention relates to an electrical contacting part consisting of a male contacting portion and a female contacting portion. The invention more specifically relates to the female contacting portion of the contacting part.

Electrical contacting parts are used at a very large scale in many fields. Aerospace, military and telecommunications fields are among the activities which make the most use of connector technology. Several specifications or standards including for example the MIL standards and more specifically the MIL-C 39029 standard, define the features that must be fulfilled by the contacting part, as for example the values of the insertion and retention forces exerted on the male contacting portion by the female contacting portion and the minimum resistance to aggressive tests such as the moment test. This test consists of applying a radial load on the male contacting portion of the contacting part at a point of its longitudinal axis located at a distance from the female contacting part, set by the standard, and then of having the female contacting portion of the contacting part perform several rotations on itself. This is a severe test for contacting parts. The achieved quality of the electrical connection essentially depends on the female contacting portion. Greatest attention was paid to the latter as early as in the design phase, as its mechanical and conducting features guarantee the high quality of the electrical contact with the male contacting portion.

Many achievements from the prior art are based on a female contacting part designed as a single portion, which then has the following drawbacks:

- the constraint of completing the integral part in a costly conducting alloy,
- the requirement of performing heat treatments on certain portions of the part in order to give them the required mechanical and conducting features,
- the requirement of covering the part or a large portion of the part with gold or silver plating having a large thickness in order to give it the desired conducting properties.

From the prior art, it is known that many creations of contacting parts resort to tulip technology. This technology requires numerous and costly manufacturing operations: first, the part is machined, then split along its longitudinal axis in several locations according to the number of required tabs, and these tabs are finally tightened together in order to form a resilient clip. These operations are all the more complex and costly as the diameter of the contacting parts is small.

Such parts do not meet the requirements of certain standards for space-borne equipment, or equipment submitted to harsh environments or large mechanical stresses. Actually, the tulip technology does not provide connectors capable of withstanding the moment test which is a required step for obtaining certain standards. During this test, the resilient tabs achieving the contact are completely deteriorated at the end of this test as they are the ones supporting the totality of the forces involved during this test.

The nearest prior art is taught by Patent EP 1 107 378 A1 relating to a contacting part for an electrical connector. This contacting part of the female type is designed in two portions: a body and a contact clip. The contact clip is fixed inside the body of the contacting part. Part of the drawbacks of the prior creations mentioned earlier may be overcome with this design in two portions: indeed, in this creation, only the contact clip has to have mechanical, notably resilient properties and conducting properties requiring the use of a costly high performance alloy. The body of the contacting part may therefore be made of a less costly alloy.

However, this creation has the following drawbacks: as the contact clip is made according to the tulip technology, it requires an operation for tightening the tabs as well as a shaping of the arcuate portion of the tabs. The contact clip is fixed inside a bore created in the body of the female contacting part, which requires costly fitting and machining operations, this all the more since the diameter of the contacting parts is small. The numerous operations for inserting and removing the male contacting parts, inherent to the normal use of the connector create a risk of pulling out the tulip from its housing located in the body of the female contacting part. The tulip shape of the contact clip also makes it more exposed to damages in the case of badly inserting a male contacting part. Therefore, connectors of this type have a certain fragility and weaknesses inherent to their design, as well as an electrical contact point relatively distant from the front face of the entrance to the female contacting part which does not correspond to requirements of certain standards. Moreover, this sort of connectors does not withstand the moment test as they are manufactured according to the tulip technique.

The object of the present invention is to overcome the drawbacks of the prior art by creating a female contacting part requiring a smaller number of manufacturing operations, therefore less costly operations, providing an increased success rate in the moment test, and an electrical contact point close to the front end of the female contacting part, thereby meeting the requirements of certain standards.

This object is achieved by a contacting part consisting of a male contacting portion and a female contacting portion, the female contacting portion consisting of a body having a longitudinal axis of symmetry and an end of which is provided with a housing axially positioned in said body and compatible with the shape and the dimensions of said male contact, an external surface portion of the body distant from this end is in electrical contact with an annular crown extending towards the aperture of the housing with at least one contact clip achieving the electrical contact with the male contacting portion, the contact clip being provided with at least two resilient tabs, joined to the annular crown, characterized in that the ends of the tabs are arranged so as to be interposed on the path for inserting the male contacting element into the housing, the inner diameter circumscribed by the ends of the resilient tabs is smaller that the inner diameter of the housing and than the external diameter of the male contacting portion.

According to another feature, the tabs have an L-shaped profile with ends forming an internal rim providing the electrical contact between the male contacting portion and the female contacting portion.

According to another feature, the resilient tabs have a length so that their free ends come into position in front of the entrance of the housing.

According to another feature, it includes a protective sleeve of an essentially tubular shape, surrounding the contact clip and including an aperture providing passage for the male contacting portion, the protected sleeve is force-fitted and set onto a cylindrical span of the body of the female contacting portion.

According to another feature, the protective sleeve is force-fitted and set onto the annular crown.

According to another feature, the dimensions of the aperture of the protective sleeve are such that they do not allow the introduction of a male contact portion with a diameter larger than the diameter of the housing.

According to another feature, the inner dimensions of the protective sleeve are such that they provide sufficient clearance of the contact clip for receiving the male contacting portion.

According to another feature, the clearance of the contact clip may be limited to a maximum admissible value with the protection sleeve.

According to another feature, the aperture of the protective sleeve has a shape for facilitating introduction and guidance of the male contacting portion.

According to another feature, the ends of the tabs form an inlet cone, the dimensions of which determine a certain number of fundamental features of the contacting part.

According to another feature, the diameter of the housing is defined relatively to the diameter of the male contacting portion in order to provide a sliding assembly, the male contact being guided into the housing.

According to another feature, the annular crown is force-fitted and set on the cylindrical portion of the body of the female contacting portion.

According to another alternative, the resilient tabs have a length so that their free ends are behind the aperture of the housing, said ends of the resilient tabs providing the contact with the male contacting portion through windows provided within the body of the female contacting portion and opening onto the housing.

According to another feature, an external protecting sleeve enhancing the tightening of the annular crown and protecting the resilient tabs from mechanical aggressions may be fixed onto the body of the female contacting portion.

According to another feature, the L-shape of the resilient tabs limits the risks of pulling out the contact clip.

According to another feature, the contact clip and the body of the female contacting portion are made of different materials.

According to another feature, the contact clip is made of a high performance alloy combining resilient and conducting properties.

According to another feature, the body of the female contacting portion is made of a conventional conducting alloy.

Figure 2:
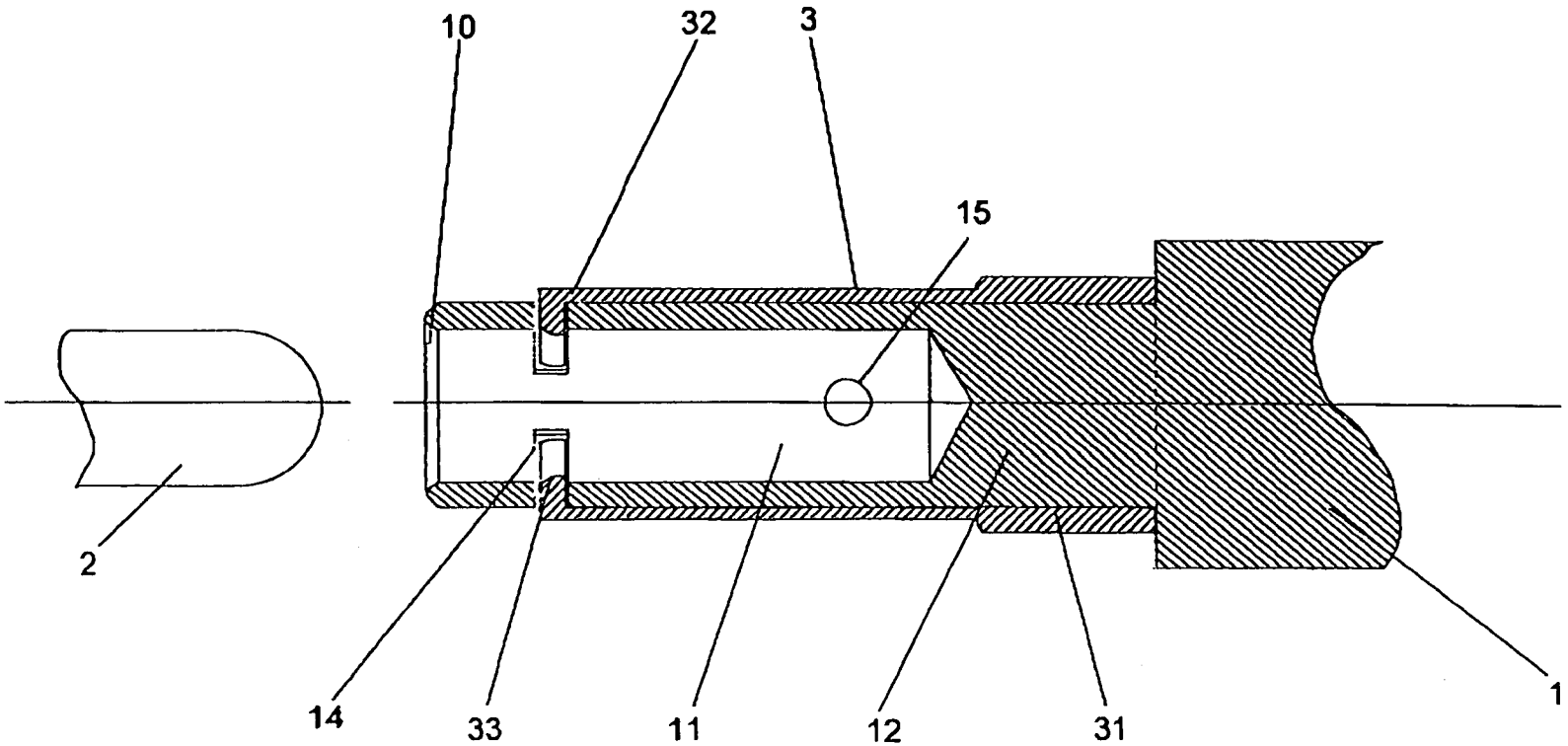
Figure 3:
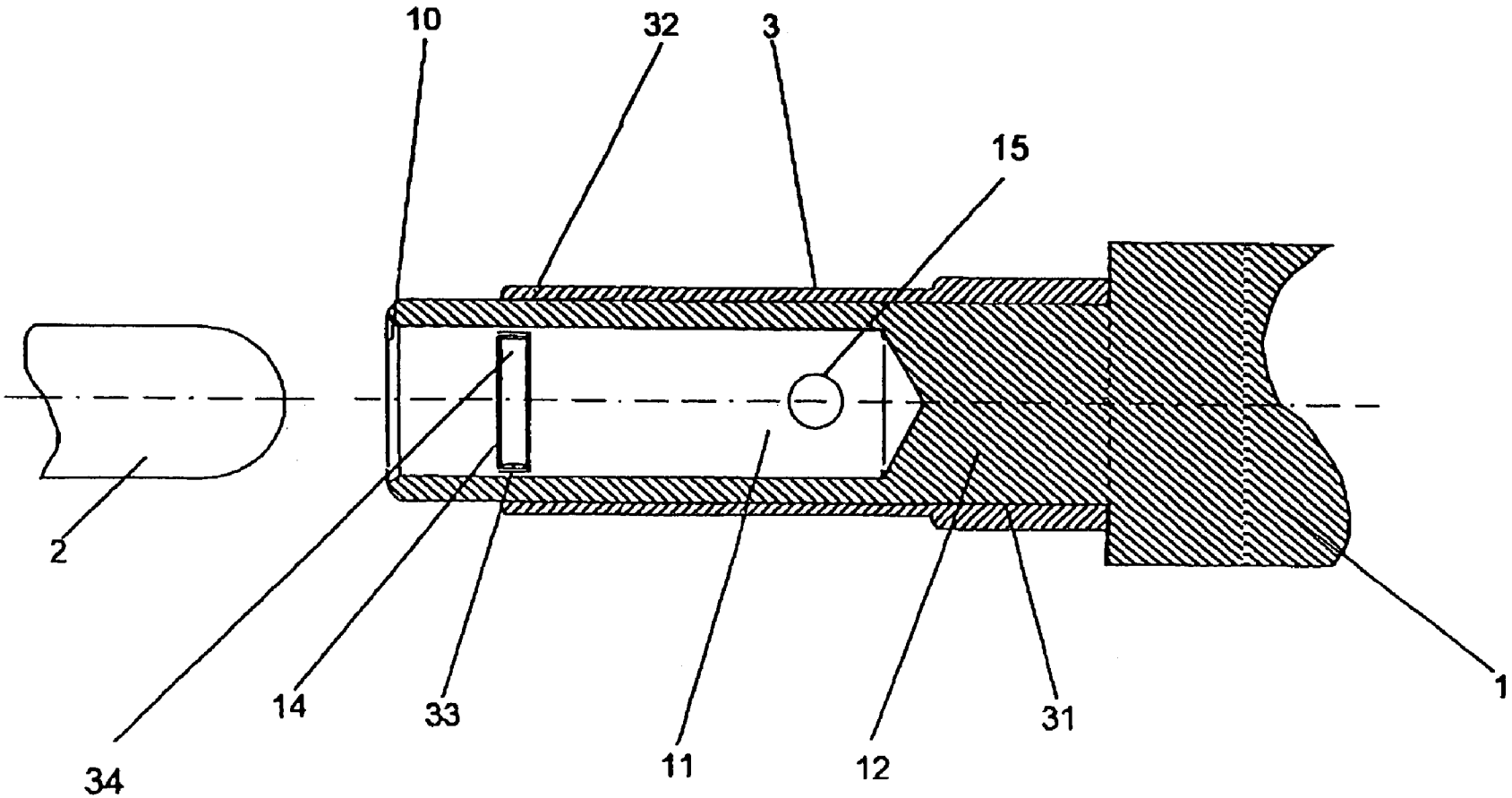
Figure 4:
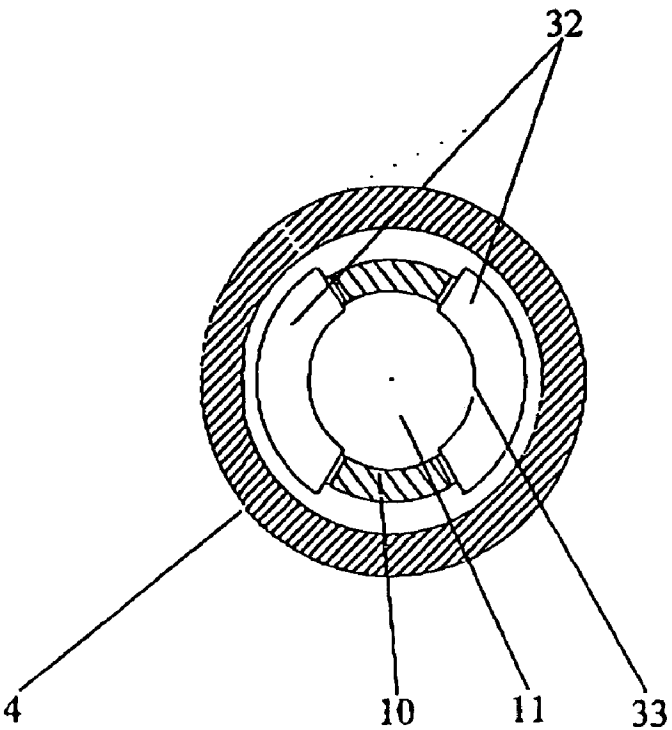
Figure 5:
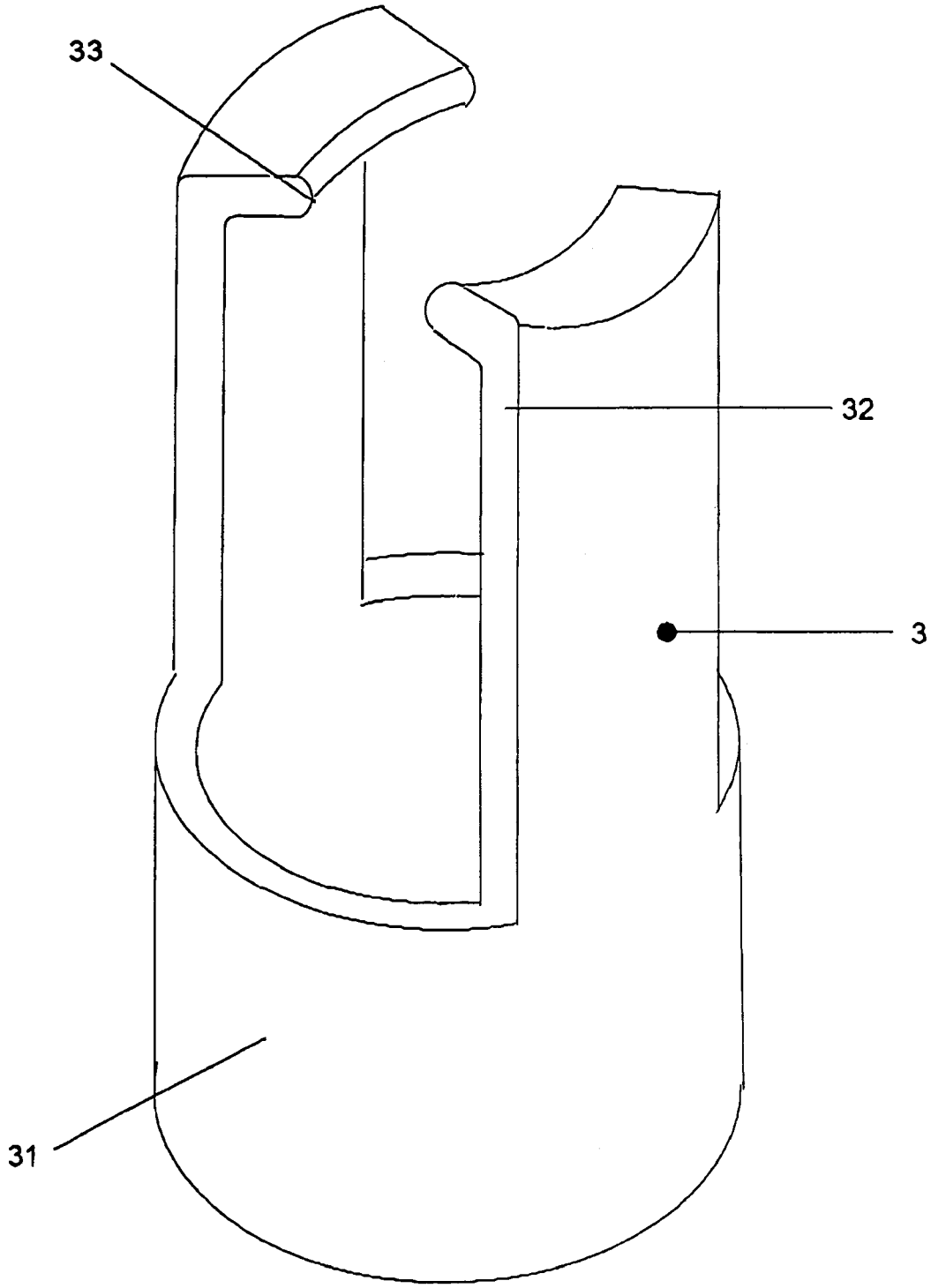
Figure 6:
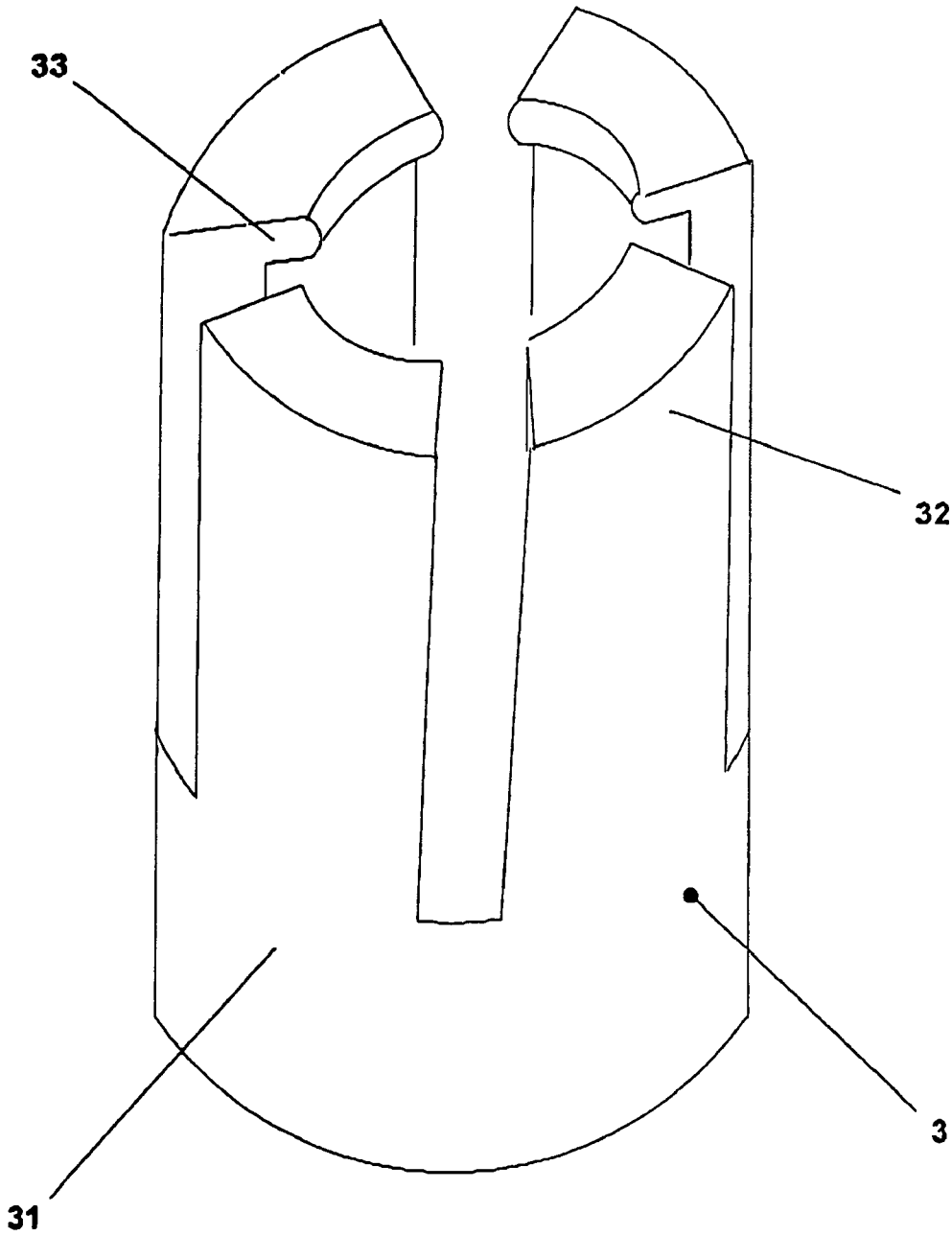

The invention, with its features and advantages will become more apparent upon reading the description made with reference to the appended drawings wherein:

FIG. 1 illustrates a sectional view along the axis of revolution of the connector of a preferred embodiment of the connector according to the invention, FIG. 2 illustrates a sectional view along the axis of revolution of the connector of a second embodiment of the connector according to the invention, the windows as viewed from the side, FIG. 3 illustrates a sectional view along the axis of revolution of the connector of the second embodiment of the connector according to the invention, the windows as viewed from the front, FIG. 4 illustrates a view along arrow A as a cut along B—B of the female portion of the connector according to the invention, FIG. 5 illustrates a general view of a contact clip of the female portion of the connector according to the invention, regardless of the selected embodiment of the invention, FIG. 6 illustrates a general view of two contact clips of the female portion of the connector according to the invention, regardless of the selected embodiment of the invention.

The contacting part according to the invention includes a male contacting portion (2) and a female contacting portion. A contact clip (3) is fixed onto a cylindrical span (12) of the body (1) of the female contacting portion of the contacting part by means of an annular portion (31), force-fitted and set onto the cylindrical span (12). The annular portion (31) should have good conducting properties. A housing (11) axially positioned within the body (1) of the female contacting portion has dimensions and a shape adapted to the male contacting portion (2). The housing (11) comprises eventually a croocked hole (15) to improve the quality of the surface treatment at the bottom of the housing (11). The male contacting element (2) is a cylinder portion ending at its front end by a hemispherical or optionally tapered cap. Thus, the inner diameter of the housing (11) will be just larger than the maximum diameter of the male contacting portion (2) allowing penetration of the latter into the housing (11). The contact clip (3) is a split revolving part with an inner rim in order to form tabs (32) with an L-shaped profile (FIGS. 5 and 6). The ends (33) of tabs (32) are formed in the inner rim.

The ends (33) of the tabs (32) provide the electrical contact with the male contacting element (2). This is why the tabs (32) must have very good conducting properties. The number of slots and therefore the number of tabs vary according to the type of contact required.

The ends (33) of the tabs (32) form an inlet cone (34). The shape and the dimensions of this inlet cone (34) determine a certain number of fundamental features of the contacting part, such as the retention and insertion forces, the electrical contact resistance, the number of maneuvers and the intensity, acceptable for the contact.

The inner diameter circumscribed by the inlet cone (34) is smaller than the diameter of the male contacting part (2). With this, a permanent contact between the male contacting element (2) and the ends (33) of the tabs (32) may be provided by the very good resilient properties of the tabs (32) which move apart when the male element (2) passes by, but remain pressed against the latter under all circumstances. In order to manufacture the contact clip (3) according to the invention, the operation for tightening the tabs practiced in the prior art is no longer absolutely necessary, allowing for substantial savings on the manufacturing costs. The external surface of the housing (11) may have a slight conicity towards the aperture (10) in order to give more clearance to the resilient tabs (32).

According to a preferred embodiment of the invention (FIG. 1), the resilient tabs (32) have a length so that their ends (33) are located in front of the aperture of the housing (11) of the body (1) of the female contacting portion. Upon inserting the male contacting portion (2), the latter first comes into contact with the ends (33) of the resilient tabs (32) of the contact clip (3) so as to move them apart before penetrating into the housing (11) located in the body (1) of the female contacting portion. The front faces of the ends (33) of the resilient tabs (32) have a suitable shape so as to cooperate with the front end of the male contacting portion (2) in order to facilitate the moving apart of the tabs (32) and the introduction of the male contacting portion (2) into the housing (11). The housing (11) enables the male contacting portion (2) to be guided over a large distance and ensures that it is well supported.

This arrangement requires the presence of a protected sleeve (4) surrounding the contact clip (3) and which may have some conducting properties. The protective sleeve (4) is force-fitted and set onto the cylindrical portion (13) of the body (1) of the female contact portion and optionally on the annular crown (31) so providing it with better support. The protective sleeve (4) provides several functions. Firstly, the hole (41) located on its front face acts as a jig accepting the passage of male contacting parts (2) of a suitable diameter and rejecting the passage of male contacting parts with a diameter larger than that acceptable by the female contacting parts. A significant cause of deterioration of the female element of the connector is thereby suppressed. Indeed, the passage of a male contacting part with a too large diameter would result in permanent deformation of the resilient tabs (32). Secondly, the internal surface of the protected sleeve (4) facing the resilient tabs (32) is of sufficient size so as not to oppose the moving apart of the resilient tabs (32) when a male contacting part (2) is introduced as long as this separation remains below a maximum value acceptable by the resilient tabs (32), and with this, any permanent deformation by exceeding the elastic deformation range of the tabs (32) may be avoided, for example in the case of badly inserting a male contacting part. The hole (41) additionally has a shape which facilitates the introduction and guidance of the male contacting portion. This protective sleeve (4) is fixed onto a cylindrical span (13) of the body (1). It tightens the annular portion (31) of the contact clip (3) on the cylindrical portion (12) of the body (1) of the female contacting portion.

This is an extra safety measure as for the pull strength of the clip (3), the latter being submitted to axial stresses from the male contacting parts (2) during the large number of connections and disconnections inherent to its operation, as well as during the moment test. The annular portion (31) has a larger external diameter than the diameter in which the external surface of the resilient tabs (32) is inscribed. This difference in diameter provides clearance space allowing the ends (33) of the resilient tabs (32) to retract sufficiently without exceeding the elastic deformation range of the tabs (32), during the passage of the male contacting portion (2).

FIG. 2 shows a second embodiment of the invention. In this second embodiment, the resilient tabs (32) of the contact clip (3) are of a length such that their ends (33) are located behind the aperture (10) of the housing (11) of the body (1) of the contacting part. The ends (33) of the resilient tabs (32) come into position in the windows (14) provided at the periphery of the body (1) and opening onto the housing (11). The shape of the windows (14) is adapted in order to allow the ends (33) of the resilient tabs (32) to penetrate into the housing (11). There are as many windows (14) as resilient tabs (32). The ends (33) of the tabs (32) thereby provide the electrical contact with the male contacting portion (2) positioned in the housing (11) through windows (14).

in this second embodiment, the ends (33) of the resilient tabs (32) also form an inlet cone (34). The inner diameter circumscribed by the inlet cone (34) is less than the diameter of the male contacting portion (2) and therefore less than the inner diameter of the housing (11).

This second embodiment of the invention does not necessarily require the presence of an external protective sleeve (4). Indeed, upon insertion of the male contacting portion (2), the latter first comes into contact with the aperture (10) of the housing (11) which is used as a jig. No male contacting element (2) with dimensions larger than those of the housing (11) may reach the contact clip (3) and therefore come and damage it. The risks of having the resilient tabs (32) and the annular portion (31) pulled out or having them slide from the contact clip (3) are limited by the L-shaped profile of the resilient tabs (32). Indeed, the ends (33) of the resilient tabs (32) press against the lower face of the windows (14) preventing the pulling out of the contact clip (3).

Both of these embodiments are closely related and have a certain number of common features and advantages.

Thus, the external position of the clip (3) relatively to the housing (11) largely simplifies the assembly operations as compared with the tulip technique. As the housing (11) is a simple cylinder, it is less complex to manufacture than the parts of the prior art. These features significantly reduce manufacturing costs. The external position of the contact clip (3) also causes the contacting part according to the invention to provide increased resistance to the moment test as compared with the tulip technology, because it is the housing (11) of the body (1) of the female contacting portion which is submitted to the stresses consecutive to the offset of the male contacting portion (2) under the applied load.

A major advantage of the design in two portions of the female contacting element is that the body (1) of the female contacting portion and the contact clip (3) may be made of different materials. Indeed, according to the principle of the invention, only tho contact clip (3) provides the electrical contact with the male contacting portion (2) by the ends (33) of the resilient tabs (32), and only it should have the required conducting and resilient features. Thus, only the contact clip (33) will be made of a suitable high performance alloy, such as for example a copper-beryllium alloy and be submitted to the various treatments required (heat treatments, gold or silver plating, etc.). On the contrary, the body (1) (and therefore the cylindrical portions (12, 13)) of the female contacting portion may be made of a cheaper conducting alloy, such as brass for example, and will be submitted to more reduced heat and surface treatments if such treatments are required as for example at the gold thickness.

The external position of the contact clip also allows the housing (11) of the female contacting portion to support the major part of mechanical stresses transmitted by the male contacting portion (2). This generates better resistance to stresses, vibrations and increased reliability of the contacting part.

The external position of the contact clip (3) finally allows a contacting point to be very close to the front face of the female contacting part as required by the most demanding standards.

in an alternative, an external protective sleeve may be added to the embodiment of FIG. 2 which improves the tightening of the annular crown (31) and protects the resilient tabs (32) from mechanical aggressions.

The present invention therefore has a simpler contacting part, which is less costly to manufacture and which provides increased resistance and reliability, notably at the moment test.

It should be apparent to those skilled in the art that the present invention allows embodiments in a large number of other specific forms without departing from the field of application of the invention as claimed. Accordingly, the present embodiments should be considered as an illustration and may be altered within the field defined by the scope of the appended claims.

What is claimed is:

1. A contacting part consisting of a male contacting portion (2) having a determined external diameter and of a female contacting portion, the female contacting portion comprising:

a body (1) having a longitudinal axis and a contacting end for receiving the male contacting portion (2), said body (1) further comprising:

a first cylindrical portion (13) extending axially toward the contacting end;

a cylindrical span (12), extending axially from the first cylindrical portion towards the contacting end, between said first cylindrical portion and a cavity defining housing (11), wherein said cavity defining housing (11) comprises a third cylindrical portion extending axially from said cylindrical span (12) towards the contacting end and defining an opening (10) into the cavity defining housing 11; and a contact clip (3) fixed onto the cylindrical span (12) in electrical contact therewith, the contact clip (3) further comprising;

a clip annular portion (31) surrounding the cylindrical span (12), the annular portion of the clip constructed having at least two axially extending tines, each of said tines terminating in a contacting tab (32), said tabs extending radially into the opening (10) and having a contact end (33) arranged so as to be interposed in the path of the male contacting element when it is inserted into the cavity defining housing (11), said contact ends (33) circumscribing an aperture (34) having an inner diameter smaller than the inner diameter of the cavity defining housing (11) and smaller than the external diameter of the male contacting portion (2), so that said contact ends (33) of the contacting tabs (32) achieve an electrical contact with the male contacting portion (2).

2. The contacting part according to claim 1, characterized in that the contact ends of the contacting tabs form an inlet cone, the dimensions of which determine a certain number of fundamental features of the contacting part.

3. The contacting part according to claim 1, characterized in that the diameter of the housing is defined relatively to the diameter of the male contacting portion in order to provide a sliding assembly, the male contact being guided into the housing.

4. The contacting part according to claim 1, characterized in that the clip annular portion is force-fitted and set onto the cylindrical span of the body of the female contacting portion.

5. A connector, characterized in that it includes at least one contacting part according to claim 1.

6. The contacting part according to claim 1, characterized in that the tines have an L-shaped profile, said contact ends forming an inner rim providing the electrical contact between the male contacting portion and the female contacting portion.

7. The contacting part according to claim 6, characterized in that the L-shape of the tines limits the risk of pulling out the contact clip.

8. The contacting part according to claim 1, characterized in that the tines have a determined length and longitudinally extend over said third cylindrical portion so that their free ends come into place in front of the aperture of the housing.

9. The contacting part according to claim 8, characterized in that the contact clip is made of a high performance alloy combining resilient and conducting properties.

10. The contacting part according to claim 1, further comprising a protective sleeve, essentially of tubular shape, surrounding the contact clip and including an aperture allowing the passage of the male contacting portion, the protective sleeve being force-fitted and set on the body of the female contacting portion.

11. The contacting part according to claim 10, characterized in that the protective sleeve is force-fitted and set on the clip annular portion.

12. The contacting part according to claim 10, characterized in that the dimensions of the aperture of the protective sleeve are such that the protective sleeve aperture does not allow the introduction of a male contacting portion with a diameter larger than the diameter of the housing.

13. The contacting part according to claim 10, characterized in that the inner dimensions of the protective sleeve are such that they provide sufficient clearance for the contact clip so as to receive the male contacting portion.

14. The contacting part according to claim 10, characterized in that the protective sleeve allows the clearance of the contact clip to be limited to a maximum acceptable value.

15. The contacting part according to claim 10, characterized in that the aperture of the protective sleeve has a shape allowing it to facilitate the introduction and guidance of the male contacting portion.

16. The contacting part according to claim 1, wherein the body of the female contacting portion comprises windows on the third cylindrical portion for providing lateral access to the housing, the contact clip having a determined length so that the contact ends of the tines are aligned with said windows, wherein said contact ends are allowed to contact the male contacting portion through said windows.

17. The contacting part according to claim 16, characterized in that an external protective sleeve, improving the tightening of the clip annular portion, thereby protecting the tines from mechanical aggression, said protective sleeve being fixed onto the body of the female contacting portion.

18. The contacting part according to claim 16, characterized in that the contact clip and the body of the female contacting portion are made of different materials.

19. The contacting part according to claim 16, characterized in that the contact clip is made of a high performance alloy combining resilient and conducting properties.

20. The contacting part according to claim 16, characterized in that the body of the female contacting portion is made of a conventional conducting alloy.

21. The contacting part according to claim 1, characterized in that the contact clip and the body of the female contacting portion are made of different materials.

22. The contacting part according to claim 21, characterized in that the body of the female contacting portion is made of a conventional conducting alloy.

* * * * *